US006679394B2

(12) United States Patent
Schuffert et al.

(10) Patent No.: US 6,679,394 B2
(45) Date of Patent: Jan. 20, 2004

(54) RING LIFT CRANE

(75) Inventors: Eberhard Schuffert, Homburg (DE); Rüdiger Zollondz, Hornbach (DE)

(73) Assignee: Demag Mobile Cranes GmbH & Co., KG, München (DE)

( * ) Notice: Subject to any disclaimer, the term of this patent is extended or adjusted under 35 U.S.C. 154(b) by 0 days.

(21) Appl. No.: 10/168,923

(22) PCT Filed: Jan. 18, 2001

(86) PCT No.: PCT/DE01/00253

§ 371 (c)(1),
(2), (4) Date: Jun. 24, 2002

(87) PCT Pub. No.: WO01/53189

PCT Pub. Date: Jul. 26, 2001

(65) Prior Publication Data

US 2003/0029826 A1 Feb. 13, 2003

(30) Foreign Application Priority Data

Jan. 19, 2000 (DE) ..... 100 02 917

(51) Int. Cl.[7] ..... B66C 23/64
(52) U.S. Cl. ..... 212/299; 212/301; 212/347
(58) Field of Search ..... 212/298, 299, 212/300, 301, 347

(56) References Cited

U.S. PATENT DOCUMENTS 2,701,647 A * 2/1955 Cope ..... 212/347
3,249,238 A * 5/1966 Hedeen ..... 212/347
3,477,522 A * 11/1969 Templeton
4,053,060 A * 10/1977 Wilson ..... 212/302
4,483,448 A * 11/1984 Wittman et al. ..... 212/189
4,489,818 A * 12/1984 Franke et al. ..... 198/311

FOREIGN PATENT DOCUMENTS

WO 99/48793 * 9/1999

* cited by examiner

*Primary Examiner*—Thomas J. Brahan
(74) *Attorney, Agent, or Firm*—Cohen, Pontani, Lieberman & Pavane

(57) ABSTRACT

The invention is directed to a ring lift crane with a liftable ring forming a circular traveling path and having a plurality of segments which can be connected to one another. Within the ring, there is arranged a chassis having a superstructure which is connected with the chassis so as to be rotatable and which has a plurality of winches. The superstructure is provided with an adapter in each of two oppositely located end areas, and the adapters are supported in a rolling manner on the circular traveling path of the ring by rollers which are arranged in the end area of the adapters. The center of the ring and chassis forms the axis of rotation and the rear adapter is constructed so as to receive a counterweight and the front adapter is constructed so as to receive a boom in the form of a lattice mast which can be articulated and which has at least one main boom, and means are provided for generating the rotating movement of the ring lift crane, and the chassis is connected with different segments of the ring by reinforcement members. A lateral reinforcement is provided at least one a lattice mast component and extends along at least one half of the length of the lattice mast component.

10 Claims, 3 Drawing Sheets

RING LIFT CRANE

PRIORITY CLAIM

This is a U.S. national stage of application No. PCT/DE01/00253, filed on Jan. 18, 2001. Priority is claimed on that application and on the following application: Country: Germany Application No.: 100 02 917.5, Filed: Jan. 19, 2000.

BACKGROUND OF THE INVENTION

1. Field of the Invention

The present invention is directed to a ring lift crane of the type having a liftable ring forming a circular traveling path and including a plurality of segments which can be connected to one another, a chassis connected to the ring by reinforcement members, and a superstructure mounted for rotation on the chassis. The superstructure has two oppositely located end areas provided with respective front and rear adaptors, each adaptor having rollers which support it for rolling on the circular traveling path, the rear adaptor being constructed to receive a counterweight, and a main boom including a lattice mast having a head end and a foot end mounted for articulation on the front adaptor.

2. Description of the Related Art

A ring lift crane of the type mentioned above is known from DE 199 14 195 A1, which corresponds to U.S. Pat. No. 6,516,961. This known ring lift crane is provided with a liftable ring forming a circular traveling path and having a plurality of segments which can be connected to one another. Within the ring, there is arranged a chassis having a superstructure which is connected with the chassis so as to be rotatable and which has a plurality of winches. The chassis also has two bridge girders extending parallel to and at a distance from one another. Each bridge girder is provided with an adapter in two oppositely located end areas and can be bolted to or unbolted from the superstructure via cross-girders. The adapters are supported on the circular traveling path of the ring by means of rollers arranged in the end area of the adapters. The center of the ring and chassis forms the axis of rotation. The rear adapter is constructed so as to receive a counterweight and the front adapter is constructed so as to receive a boom in the form of a lattice mast which can be articulated, has at least one main boom and is provided with means for generating the rotating movement of the ring lift crane. The chassis is connected with different segments of the ring by reinforcement members.

This known ring lift crane has limited lifting capacity because it can not transmit larger forces.

SUMMARY OF THE INVENTION

It is the object of the invention to provide a ring lift crane of the type mentioned above whose lifting capacity can be significantly increased in a simple manner.

According to the teaching of the invention, a lateral reinforcement is provided at least at one lattice mast component (main boom, fly jib, mast, luffing support) and extends along at least one half of the length of the lattice mast component. The main boom preferably has a lateral reinforcement whose foot end, like the foot end of the main boom, is connected in an articulated manner with the front adapter and whose head end is fixedly connected with an element of the main boom. In order to achieve maximum effect, the lateral reinforcement extends over the entire length of the main boom, so that the head end of the reinforcement is fixedly connected with the head piece of the main boom. The suggested principle of the arrangement of a lateral reinforcement is also advantageous for other lattice mast components such as a mast, fly jib and luffing support. The lateral reinforcement comprises at least one anchoring element which is arranged to the right and to the left at a distance to and parallel to the respective lattice mast component and which is connected at defined intervals via connection elements to the respective lattice mast element. For purposes of a particularly effective reinforcement, it can be advantageous when two anchoring elements, instead of one anchoring element, are provided per side. The connection between the anchoring element and the lattice mast element is preferably constructed as an isosceles triangle, the distance of the anchoring element from the lattice mast element corresponding at least to one half of the width of the lattice mast element. Depending on the design of the overall construction, the distance can also correspond to two- to four-times the width.

The suggested arrangement results in a reinforcement of the respective lattice mast component, preferably of the main boom in both lateral directions, and the arrangement can be tensile loaded or compression loaded when bars or tube are used as anchoring elements. Preferably, each bar or tube was a length corresponding to the length of the mast. Cables may also be used as anchoring elements. In another feature of the invention, as an alternative to lateral anchoring, lifting capacity can be increased in that the mast is constructed as a double-mast whose foot pieces are connected in an articulated manner to the front adapter. This also applies to a combination of double-main boom without lateral reinforcement in connection with a fly jib which is provided with a lateral reinforcement.

Further features, advantages and details of the invention result from the following description of an embodiment example shown in a drawing.

DETAILED DESCRIPTION OF THE PRESENTLY PREFERRED EMBODIMENTS

Figure 1:
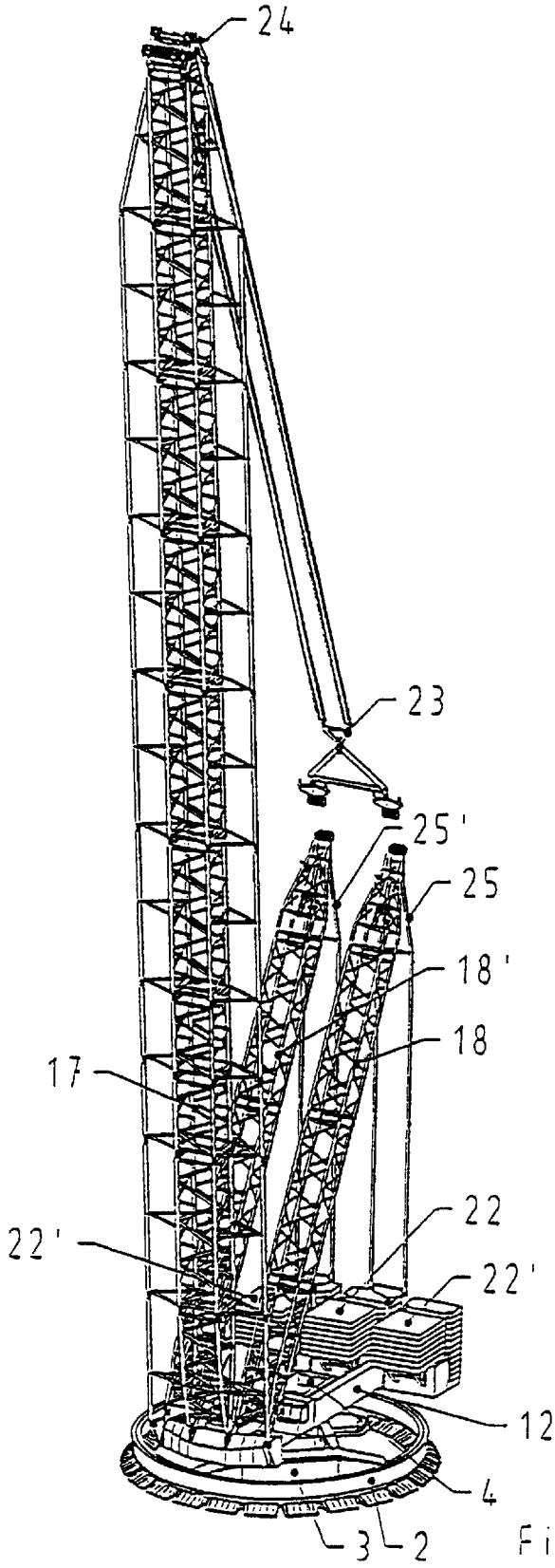
FIG. 1 is a perspective view of a ring lift crane which is constructed according to the invention.
Figure 5:
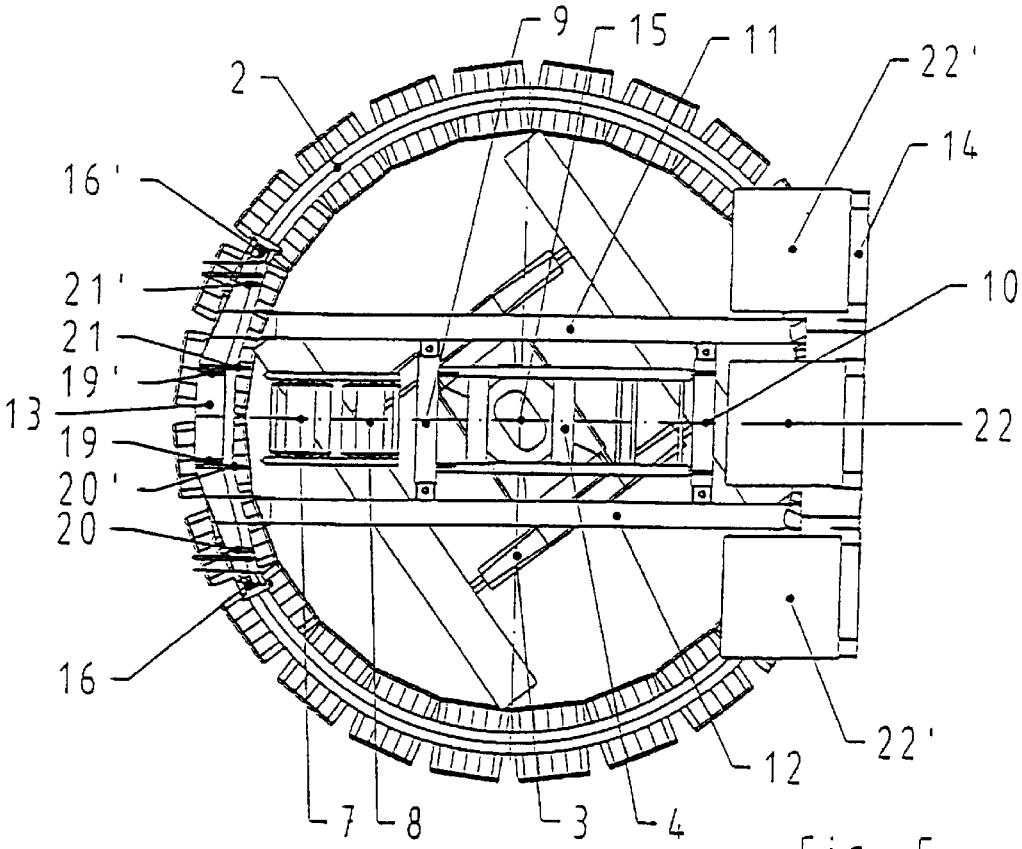
FIG. 5 is a top view of the ring lift crane without boom.

FIG. 1 shows a perspective view of an embodiment example of a ring lift crane constructed according to the invention. It has a liftable ring 2 which is composed of individual segments, not shown, A chassis 3 on which a superstructure 4 is mounted so as to be rotatable is arranged within the ring 2. A plurality of winches 7, 8 are arranged in a row on the superstructure 4 (FIG. 5). In this embodiment example, the superstructure 4 is connected by cross-girders 9, 10 to two bridge girders 11, 12 which extend along the ring 2 parallel to one another. An adapter 13, 14 which is supported on the circular path of the ring 2 by rollers 16, 16' which are indicated only schematically is provided in each end area of the two bridge girders 11, 12. The center 15 of the ring 2 and chassis 3 forms the axis of rotation for the superstructure 4. The adapter 13 shown at left in FIG. 5 serves to receive a main boom 17 and, in this embodiment example, a double-mast 18, 18'. Alternatively, an individual mast could also be provided with lateral reinforcement. The articulation points 19, 19' for the main boom 17, which lie on an articulation axis, and the articulation points 20, 20', 21, 21' for the double-mast 18, 18', which lie on a separate articulation axis, are shown in FIG. 5 at the adapter 13 located on the left-hand side. The adapter 14 located at right is constructed for receiving the counterweight 22, 22'.

In this embodiment example, the boom comprises the main boom 17 and the double-mast 18, 18' already mentioned above. The double-mast 18, 18' is connected on one side to the head piece 24 of the main boom 17 by an anchoring element 23 which can be adjusted in length and, on the other side, to the counterweight 22 by a fixed anchoring element 25, 25'.

Figure 2:
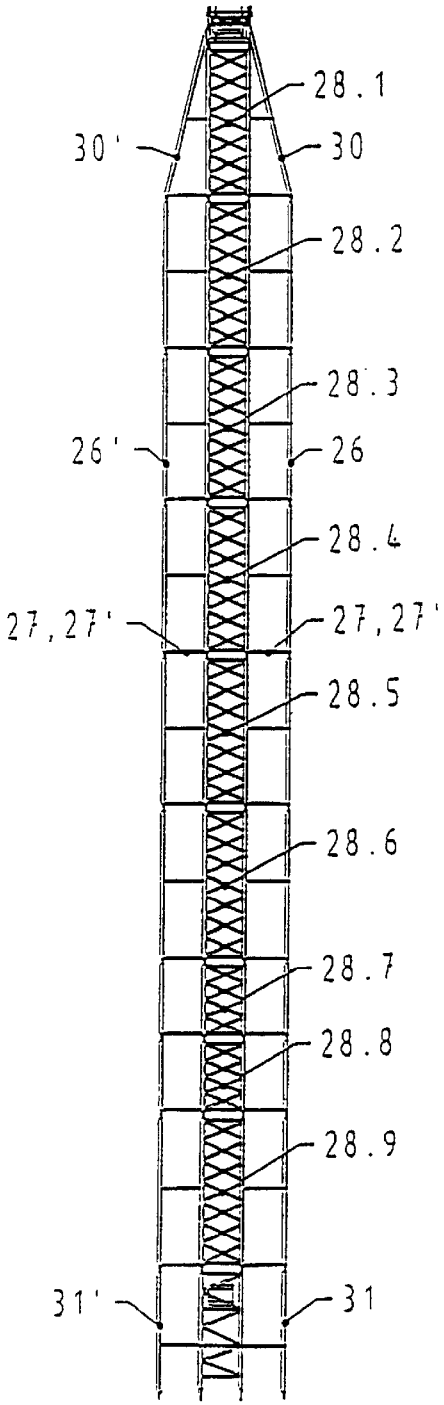
FIG. 2 is a front view in partial section showing the main boom.
Figure 3:
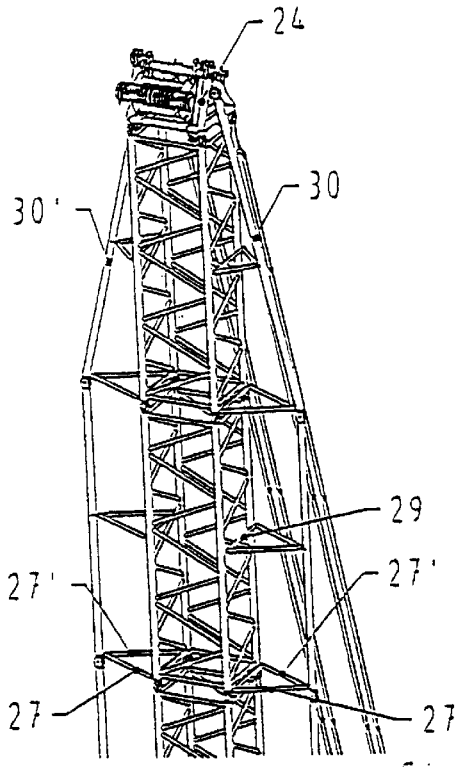
FIG. 3 is a view in enlarged scale showing the head area of the main boom.
Figure 4:
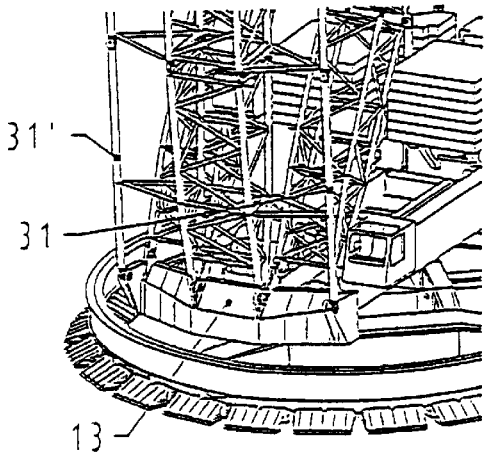
FIG. 4 is a view in enlarged scale showing the foot area of the main boom connected to the adapter.

According to the invention, the main boom 17 is provided with a lateral reinforcement (FIGS. 2 to 4). This lateral reinforcement comprises an anchoring According to the invention, the main boom 17 is provided with a lateral reinforcement (FIGS. 2 to 4). This lateral reinforcement comprises an anchoring element 26, 26' which is connected to the lattice mast 28 of the main boom by connection elements 27, 27'. The two connection elements 27, 27' form an isosceles triangle with the cross-member 29 arranged at the lattice mast 28. A pair of connection elements is provided on each side of said lattice mast in each of a plurality of planes extending through the lattice mast transversely of its length. The head end 30, 30' of the lateral reinforcement is connected with the head piece 24 of the main boom 17. The foot end 31, 31' is connected in an articulated manner with the front adapter 13.

What is claimed is:

1. A ring lift crane comprising a liftable ring forming a circular traveling path and comprising a plurality of segments which can be connected to one another, said ring having a center which forms an axis of rotation, a chassis having a center located on said axis of rotation, reinforcement members connecting said chassis to said ring, a superstructure mounted for rotation on said chassis, said superstructure having two oppositely located end areas provided with respective front and rear adaptors, each said adaptor having rollers which support it for rolling on said circular traveling path, said rear adaptor being constructed to receive a counterweight, and a main boom comprising a lattice mast having a head end, a foot end mounted for articulation about an articulation axis on said front adaptor, a length between said head end and said foot end, a pair of opposite sides, a width parallel to said articulation axis between said sides, and lateral reinforcement for said lattice mast extending along at least half of said length on each of said opposite sides, said lateral reinforcement comprising an anchoring element arranged parallel to said lattice mast on each of said sides, and a pair of connection elements on each side of said lattice mast in each of a plurality of parallel planes extending through said lattice mast transversely of said length, said lattice mast having a cross-member connecting each pair of connection elements to form a triangle.

2. A ring lift crane as in claim 1 wherein each said anchoring element comprises a foot end mounted for articulation about said articulation axis on said front adaptor and a head end fixedly connected to said lattice mast.

3. A ring lift crane as in claim 2 wherein said head end of said lateral reinforcement is connected to said head end of said lattice mast.

4. A ring lift crane as in claim 1 wherein each said triangle is an isosceles triangle.

5. A ring lift crane as in claim 1 wherein the distance between said planes is less than or equal to the length of the lattice mast.

6. A ring lift crane as in claim 1 wherein said anchoring elements comprise one of bars and tubes having a length which corresponds to the length of the lattice mast.

7. A ring lift crane as in claim 1 wherein said anchoring elements comprise cables.

8. A ring lift crane as in claim 1 wherein the anchoring elements are spaced from the lattice mast by a distance which is at least one half the width of the lattice mast.

9. A ring lift crane as in claim 8 wherein the distance is two to four times the width of the lattice mast.

10. A ring lift crane as in claim 1 further comprising a double mast without lateral reinforcement, said double mast comprising foot pieces mounted for articulation on said front adaptor, and a head piece connected to the head end of the lattice mast by an anchoring element having an adjustable length and connected to the counterweight via a fixed anchoring element.

* * * * *